US005272787A

United States Patent [19]

Salena et al.

[11] Patent Number: 5,272,787

[45] Date of Patent: Dec. 28, 1993

[54] OVERHEAD CONCEALED DOOR CLOSER, MECHANICALLY, HYDRAULICALLY OPERATED

[76] Inventors: Mike Salena; Michael Salena, both of 5321 Amestoy, Encino, Calif. 91316

[21] Appl. No.: 996,471

[22] Filed: Dec. 23, 1992

Related U.S. Application Data

[63] Continuation of Ser. No. 742,014, Aug. 8, 1991, abandoned.

[51] Int. Cl.[5] ..... E05F 3/04

[52] U.S. Cl. ..... 16/56; 16/62

[58] Field of Search ..... 16/56, 51, 62, 66, 64, 16/69

[56] References Cited

U.S. PATENT DOCUMENTS

| | | | |
|---|---|---|---|
| 2,460,364 | 2/1949 | Stronach | 16/56 |
| 3,040,372 | 6/1962 | Ellis | 16/62 |
| 3,087,720 | 4/1963 | Catlett | 16/62 |
| 3,135,991 | 6/1964 | Ellis | 16/62 |
| 3,137,888 | 6/1964 | Blom | 16/56 |
| 3,156,001 | 11/1964 | Schmid | 16/64 |
| 3,156,002 | 11/1964 | Schmid | 16/62 |
| 3,255,482 | 6/1966 | Flint | 16/56 |
| 4,483,043 | 11/1984 | Tillmann | 16/56 |
| 4,785,493 | 11/1988 | Tillmann et al. | 16/56 |

*Primary Examiner*—Lowell A. Larson
*Assistant Examiner*—Michael McKeon
*Attorney, Agent, or Firm*—Charles N. Hilke

[57] ABSTRACT

An overhead concealed door closer, hydraulicly operated, within a narrow housing case which fits within a header. The housing case has a step radius design along one side and the aperture for the pinion is off-center toward the step radius design side. Hydraulics within the housing case provide a back check, delayed closing, controlled closing, and latch closing. A rack slide is provided with a broadpoint slot so that a broadpoint extending from a pinion can slide through the broadpoint slot and into the broadpoint slot housing well of the housing case.

7 Claims, 5 Drawing Sheets

FIG. 5
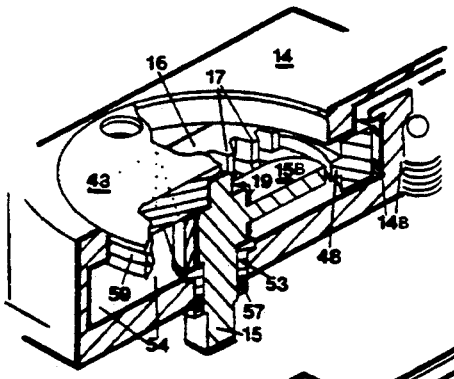
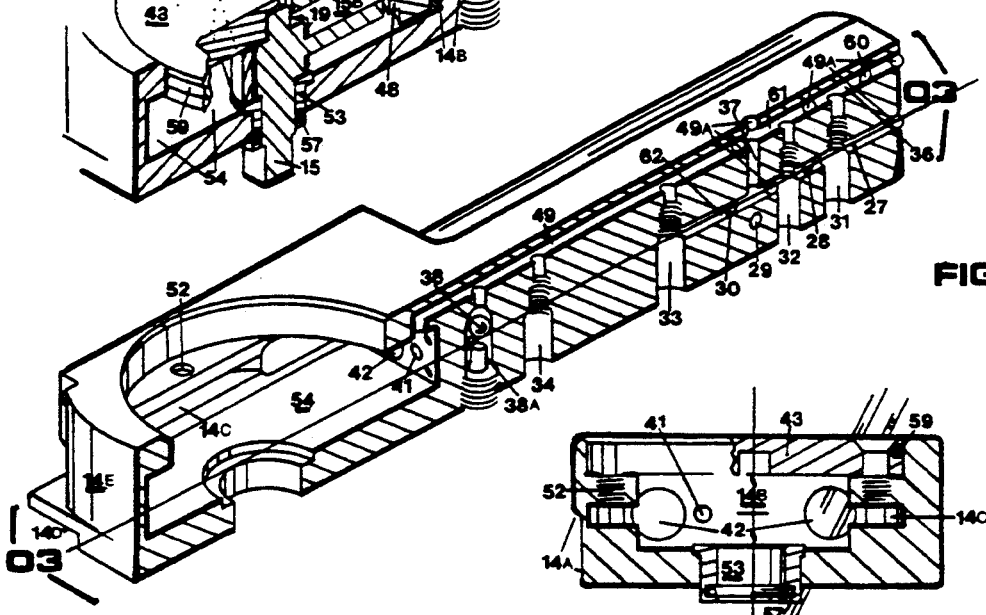
FIG. 3
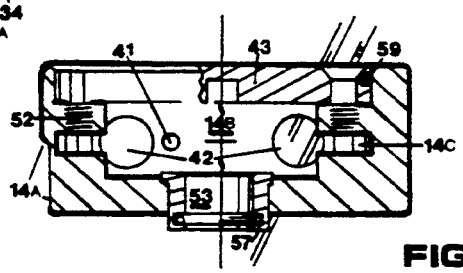
FIG. 4
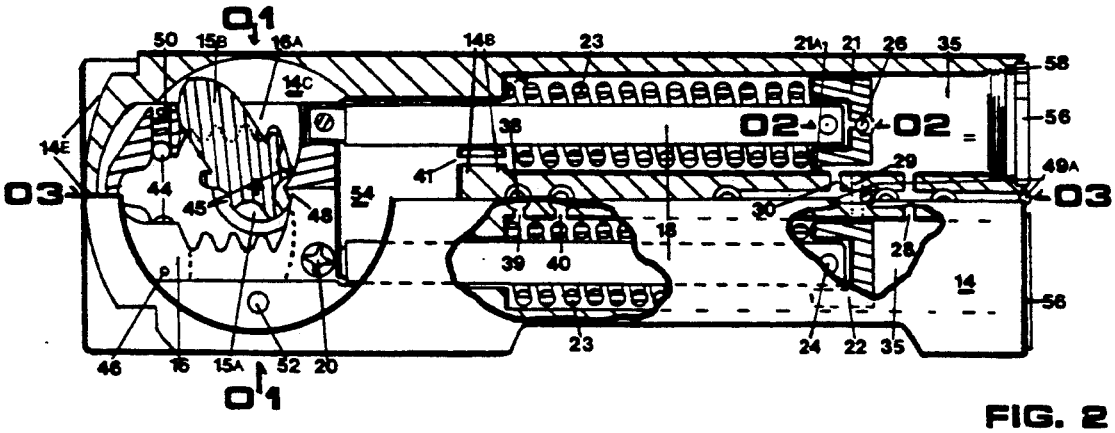
FIG. 2

OVERHEAD CONCEALED DOOR CLOSER, MECHANICALLY, HYDRAULICALLY OPERATED

This is a continuation of co-pending application Ser. No. 07/742,014 filed on Aug. 8, 1991, now abandoned.

BACKGROUND OF THE INVENTION

1. Field of the Invention

This invention relates to door closers and, more specifically, to overhead concealed door closer.

2. Prior Art

Cam and roller type mechanisms are available for overhead concealed door closer. Friction in the metal to metal contact limit the life of this style door closer. In addition, the hydraulic fluid tends to leak. What is needed is a door closer with long life and minimal, if any, hydraulic fluid leak.

SUMMARY OF THE INVENTION

A housing case comprises a step radius design along the outside of one of the elongated sides of the housing case. An aperture through the bottom of the housing case is off-center towards the step radius design. The housing case fits within a header such that the aperture is centered with respect to the header. One end of a pinion extends through the aperture of the housing case which fits within a top arm assembly fixably attached to the top of a door. The other end of the pinion is pivotably mounted to a circular closure plate at the top of the housing case. The pinion, with pinion gears and broadpoint, operates connectively with rack slide which is fixably connected to two connecting rods and pistons. A cylindrical tempered spring fits around each connecting rod between the piston and intrium wall.

Hydraulically, basicly four conditions of operation are used. The door opens freely inwardly or outwardly until the door is open 70 degrees from the closed position. At 70 degrees back check valve operates to restrict the fluid flow from behind one piston to the well at interior of the housing casing. This is accomplished by means of the other piston sealing hydraulic flow between the two areas behind both pistons and restriction of flow hydraulic back check hole.

The delayed action occurs when the door is closing from 120 degrees to 70 degrees. Springs force the pistons to move towards closure caps. The hydraulic fluid is forced through hydraulic chamber for delayed action. The delayed action valve restricts the hydraulic fluid flow. This continues until the door is 70 degrees open.

Normal closing speed occurs from 70 degrees to 10 degrees open. Fluid flows through hydraulic chamber for closing speed until 10 degrees open is reached at which point piston notch seals hydraulic chamber for latch.

Latch valve controls the fluid flow through last chamber until the door reaches center rest.

It is an object of the invention to minimize wear on parts.

It is an object to permit the door to open further.

It is another object to keep the door closed in high wind.

It is another object to provide a door closer which is more easily replaceable.

It is a an object to provide a positive closing door closer without passing the center space of a jamb-frame.

It is a final object to provide independently adjustable valve controls for a hydro-cushion back check during a door opening, delayed action closing, self-closing, and latch.

DESCRIPTION OF THE DRAWINGS

FIG. 2 is cut-away top view of the invention.

FIG. 3 is a sectional view along lines 03—03 of FIG. 2.

FIG. 4 is a cross-sectional view along lines 01—01 of FIG. 2.

FIG. 5 is cross sectional detailed view of a portion of the rack and pinion slide arrangement.

DESCRIPTION OF THE PREFERRED EMBODIMENT

Figure 1:
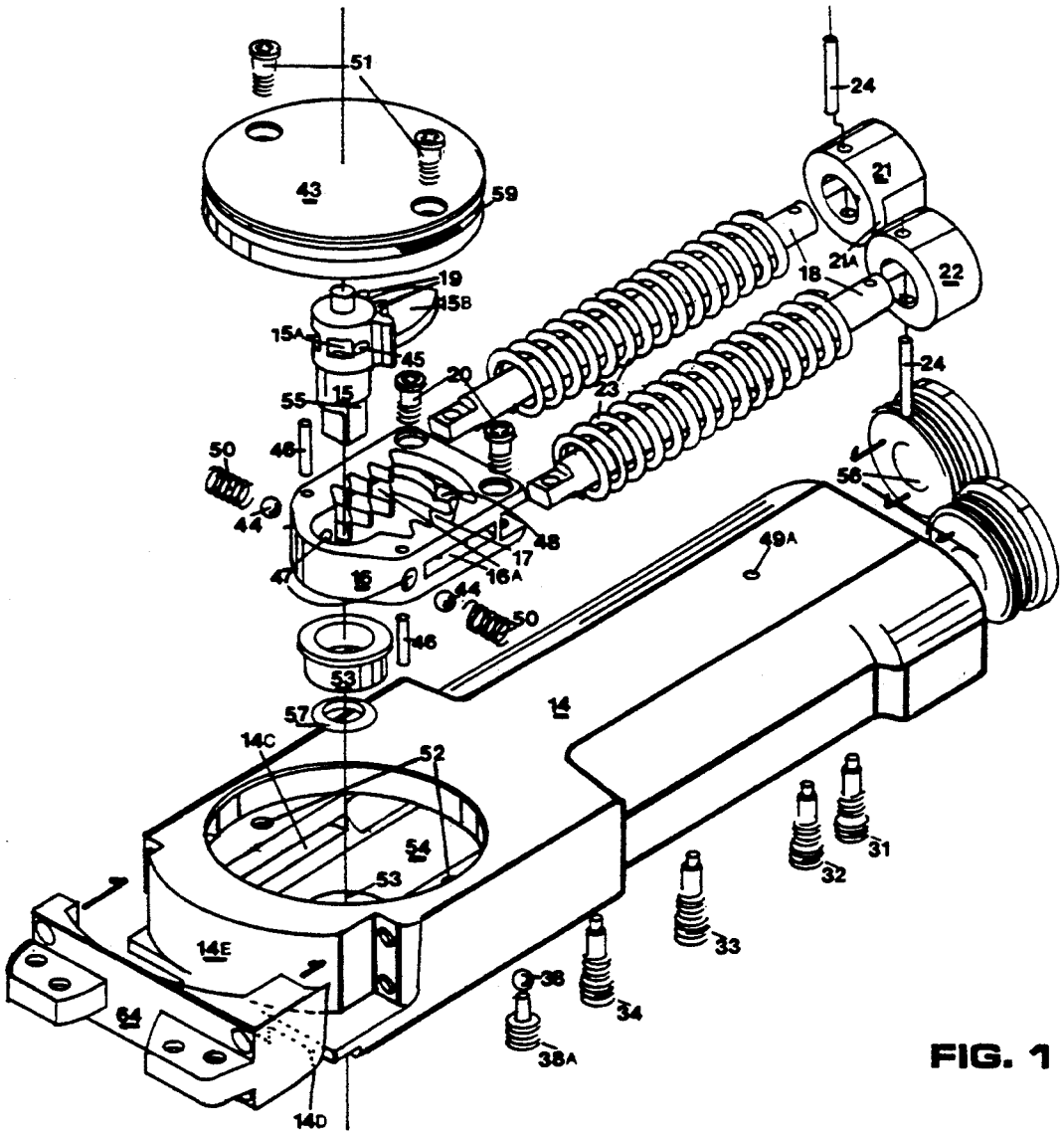
FIG. 1 is a perspective view of the unassembled invention.

FIG. 1 shows the housing case 14 with closure caps 56 located at one end and a curve arch butt 14E at the other end. An integral curve arch butt case anchor 64 is affixed to the curve arch butt 14 E. Recessed prong tab slots 14D are underneath the curve arch butt 14E. Latch valve 31, close valve 32, delay action valve 33, and back check valve 34 are positioned in the bottom of the housing case 14. Hydraulic ball hole back check 38A and back check ball 38 are also positioned in the bottom of housing case 14. One of the hydraulic plug off balls 49A is shown on the top of housing case 14.

Aperture at the bottom of housing case 14 is fitted with neoprene bushing seal 57 at the bushing 53. Pinion 15 pivotably mounted in circular closure plate 43, extends through back slide 16, the bushing 53 and extends but the bottom of housing case 14. The pinion 15 has pinion gears 19 and broadpoint 15B extending outwardly. Stabilizer ball holes 45 are positioned on the pinion 15 so that stabilizer ball 44 will be urged by stabilizer ball springs 50 held in place in stabilizer ball holes 47 in the rack slide 16 by stabilizer lock pins 46. Broadpoint slot 16A is cut through the rack gear 17 and the sides of the rack slide 16. A stabilizer rack rise 48 is positioned near the rod screws 20 which connect the rack slide-16 to the connecting rods 18. The pinion 15 and rack slide 16 are in the well at interior 54 of the housing case 14 by closure plate 43 held by closure plate screws 51 to the closure plate holes 52.

Springs 23 surround each connecting rod 18. One connecting rod 18 has a piston 21 with a piston notch 21 attached by means of piston rod pin 24. The other connecting rod 20 is attached to piston 22 by means of a piston rod pin 22.

FIG. 2 shows the position of the door closure open 120 degrees. The broadpoint 15B is shown rotated through the broadpoint slot 16A of rack slide 15 and broadpoint slot housing well 14C. The rack slide 16 is in its closest position to the curve arch butt 14 E. Pinion allowance degree 15A is shown clearing stabilizer rack rise 48. The connecting rods 18 have pulled the piston 21 with ball 26 and piston 22 in their closest position to the intrium wall 14B which provides maximum compression of springs 23. The closure caps 56 are screwed into cylindrical bores 35 sealed with neoprene seals 58. Hydraulic chamber for latch 28, hydraulic chamber for back check 29, and hydraulic chamber for delayed action 30 are shown. The piston notch 21A is shown. The hydraulic back check hole 40 connects to back check valve 34 (not shown). Chamber for back check 39 is shown near back check ball 38. Apex hole 41 is shown through the intrium wall 14B.

FIG. 3 shows additional features. The apex hole 41 is shown at the well at Interior 54 of the housing case 14. Hydraulic main chamber 49 is shown connecting with the well at interior 54, hydraulic ball hole back check 38A, back check valve 34, and delayed action valve 33. Hydraulic middle main chamber for delayed action 62 is shown with hydraulic chamber for delayed action 30. Hydraulic middle upper chamber 61 is shown connecting with close valve 32. Hydraulic chamber for closing speed 37 is shown between chambers 61 and 62. Hydraulic upper chamber 36 connects to latch valve 31 and hydraulic last chamber 60. Hydraulic midchamber 27 is shown. Hydraulic chamber for latch 28 is shown between close valve 32 and latch valve 31. Note that hydraulic chamber for back check 29 connects only between cylinder bores 35.

FIG. 4 shows the intrium wall 14B with apex hole 41 and two rod holes 42 for the connecting rods 18. The step radius design 14A is shown. The broadpoint slot housing well 14C are shown for receiving the broadpoint 15B. The closure plate holes 52 are shown. The bushing 53 is shown with the neoprene seal 57.

FIG. 5 shows neoprene seal 59 at V-groove in cylinder closure plate 43. A cross-section of the pinion 15, pinion gear 19, and broadpoint 15B is shown with the broadpoint 15B adjacent to stabilizer rack rise 48. Rack gear 17 is shown on the rack slide 16. The pinion 15 is shown protruding from the bushing 53.

Figure 6:
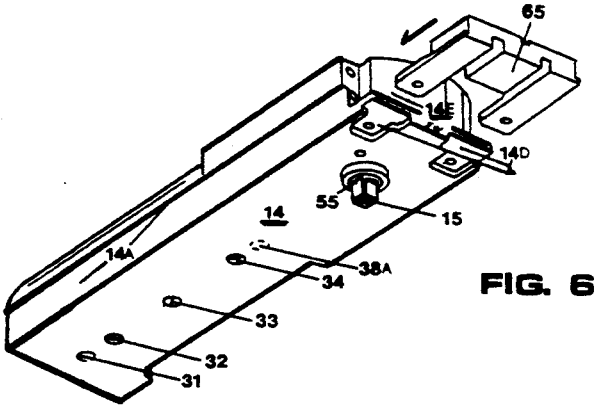
FIG. 6 is a bottom view of the invention.

FIG. 6 is perspective view of the bottom of the housing case 14. The step radius design 14A is shown along the curve arch butt 14E and recessed prong tab slots 14D. Prong tab cast anchor 65 is shown. The latch valve 31, close valve 32, delayed action valve 33, back check valve 34 and hydraulic ball hole back check 38A are shown in their easily accessible positions. Pinion 15 protrudes from the housing case 14.

Figure 7:
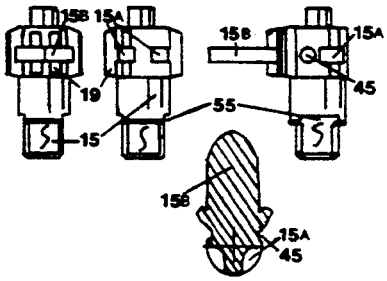
FIG. 7 is a series of views of the pinion.

FIG. 7 shows various views of the pinion 15 which completely describe the positions of the broadpoint 15B, pinion allowance degree 15A, stabilizer ball holes 45, and pinion gear 19. Pinion shaft knob 55 is shown which is square and milled for stress.

Figure 8:
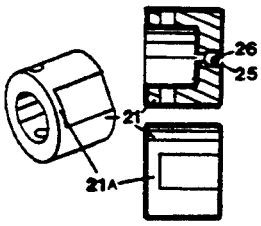
FIG. 8 is a view along lines 02—02 of FIG. 2.

FIG. 8 is a detailed series of piston with ball 21. The piston ball 26 is shown in piston ball hole 25 through the piston with ball 21. Piston notch 21A is shown.

Figure 9:
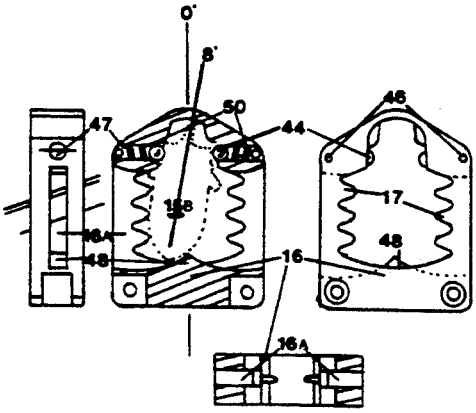
FIG. 9 is a series of views of the rack slide.

FIG. 9 is a series of detailed news of the rack slide 6. The broadpoint slot 16A is shown cut through the rack gear 17. Stabilizer rack rise 48 is shown at the base of the rack slide 16. The stabilizer balls 44 and the stabilizer ball springs 50 are in the stabilizer ball holes 47 held in place by stabilizer lock pins 46.

Figure 10:
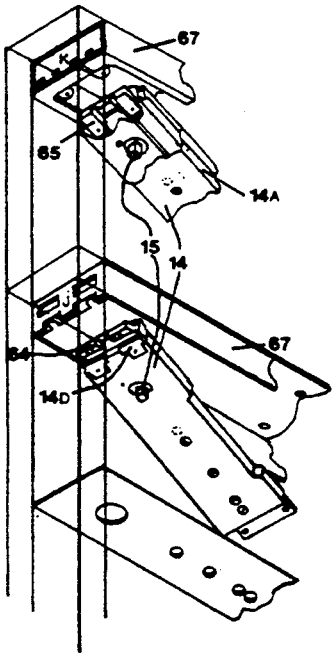
FIG. 10 is a perspective view of headers within which the invention is placed.

FIG. 10 shows two different ways that the housing case 14 is placed in a header 67. In one way, the prong tab cast anchor 65 connects the housing case 14 to the header 67, in the other way, the integral curve arch butt cast anchor 64 connects the housing case 14 to the header 67.

Figure 11:
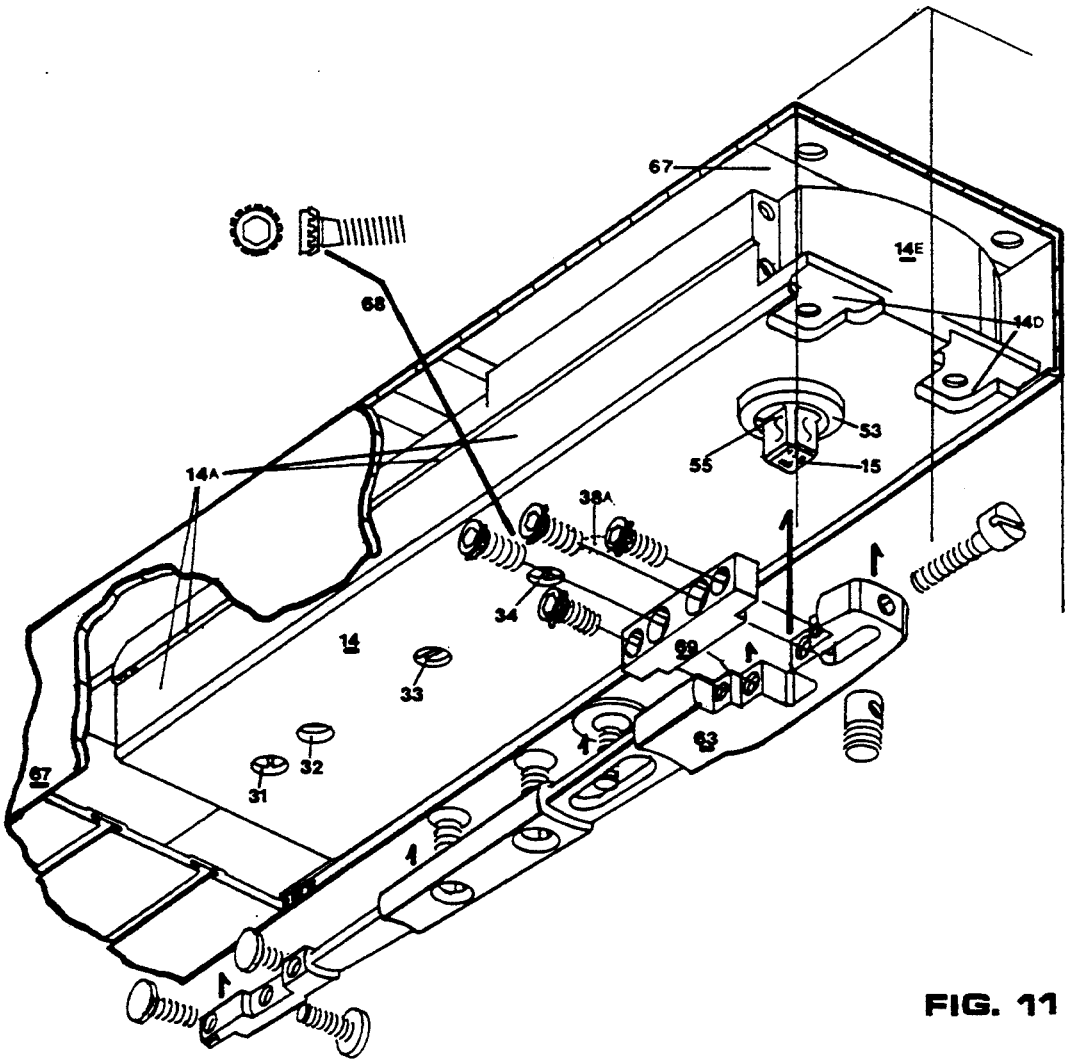
FIG. 11 is a view of the invention in a header.

FIG. 11 shows the top arm assembly 63 which is attached to the top of the door (not shown). The top arm assembly 63 is attached to the pinion by block 69 held by four block screws 68.

Figure 12:
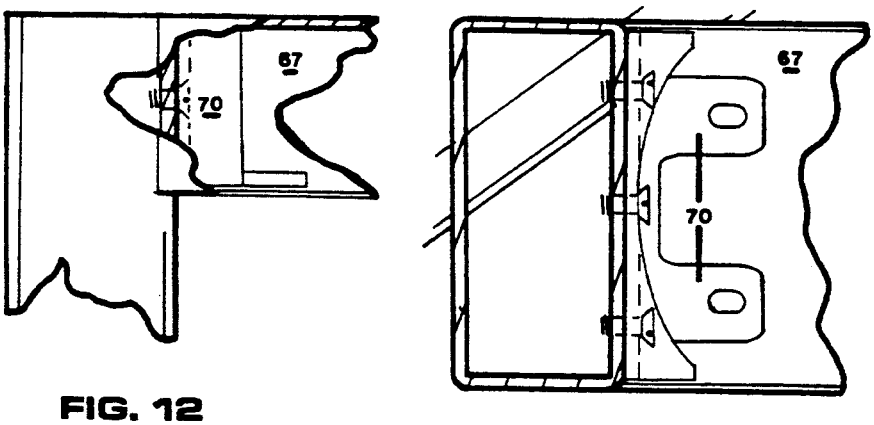
FIG. 12 is a view of the jamb anchor for the invention.

FIG. 12 shows a cast jamb anchor 70 in the header 67 to attach the housing case 14.

Figure 13:
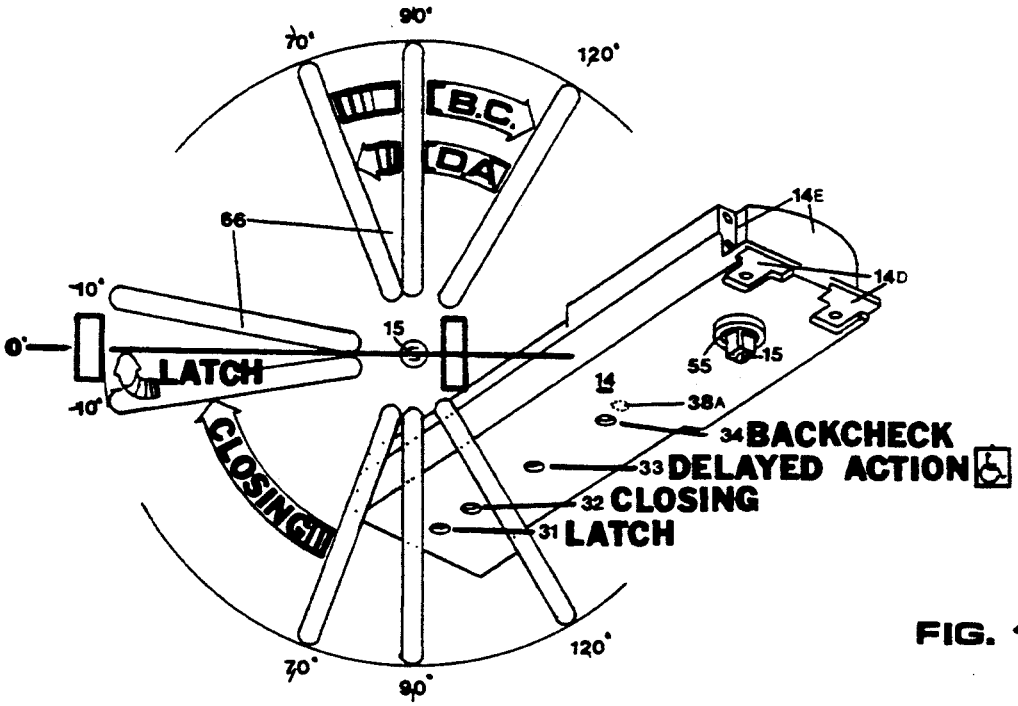
FIG. 13 is top view of a door which shows hydraulic conditions in terms of degrees.

FIG. 13 is a schematic draw showing a double acting door with back check shown between 70 degrees and 120 degrees and delayed action between 120 degrees and 70 degrees. Closing is shown between 70 degrees and 10 degrees. Latch is shown between 10 degrees and 0 degrees.

In operation, the door, which is double acting, can be pushed or pulled opened as is shown in FIG. 13. Once the door moves the top arm assembly 63 moves causing pinion 15 to rotate. Enough force must be used to open the door so that the stabilizer balls 44 overcome the force of stabilizer ball springs 50 and slide out of stabilizer ball holes 45 in the pinion 15. Pinion gears 19 engage rack gears 17 which cause the rack slide 16 to move towards the curve arch butt 14E of the housing case 14. Note that since the door is double acting, rack gears 17 are engaged on one side or the other of the rack slide 16 depending on whether the pinion 15 rotates clockwise or counterclockwise. The broadpoint 15B moves through the broadpoint slot 16A and through the broadpoint slot housing well 14C. As the rack slide 16 moves the connecting rods 18 and pistons 21, 22 move compressing springs 23 between the intrium wall 14B and pistons 21, 22.

There are essentially five reservoirs which through which fluid is interchanged: (1) the area above piston 21; (2) the area above piston 22; (3) the area below piston 21 and above intrium wall 14B; (4) the area below piston 22 and above intrium wall 14B; and (5) the well at interior 54 of the housing case.

When opening from 0 degrees to 70 degrees the ball positioned so fluid can transfer from below piston 21 to above piston 21. Hydraulic chamber for back check 29 transfers from below piston 22 to below piston 21. Hydraulic fluid transfers from above piston 21 to above piston 22 initially by hydraulic last chamber 60 and, later, also by hydraulic chamber for latch 28.

When opening from 70 degrees to 120 degrees, the back check is operating. Hydraulic chamber for back check 29 is closed by pistons 21 and 22. Hydraulic chamber for delayed action 30 is closed by piston notch 21. The back check ball seals hydraulic ball hole back check 38A. Thus back check valve 34 is the only way for fluid to exit from below piston 22. The hydraulic fluid flows as follows:

from below piston 22;
to hydraulic back check hole 40;
to back check valve 34;
to hydraulic main chamber 49;
to well at interior 54;
to apex hole 41;
to below piston 21;
to piston ball hole 25;
to above piston 21;
to hydraulic chamber for latch 28;
and hydraulic last chamber 60;
to above piston 22.

Mechanically the broadpoint 15B is positioned as shown in FIG. 2. The pinion allowance 15A slides over stabilizer rack rise 48. This provides a mechanical stop not a hydraulic stop. Springs 23 are at maximum compression.

When the door is closing from 120 degrees to 70 degrees, the springs push the pistons 21, 22 away from the intrium wall B. This causes the rack slide 16 towards the closure caps 56. Pinion 15 rotates towards door closure position. Ball 26 closes and ball 38 is free. Pistons 21, 22 plug hydraulic chamber for back check 29. However, hydraulic chamber for delayed action 30 is open because of piston notch 21A.

The hydraulic fluid flow is as follows:

from above piston 22;
to hydraulic last chamber 60, and hydraulic chamber for latch 28;
to above piston 21;
to hydraulic chamber for delayed action 30;
to hydraulic middle main chamber 62;
to delayed action valve 33;
to hydraulic main chamber 49;
to both well at interior 54, thence apex hole 41, then below piston 21;
and hydraulic ball hole back check 38A thence to hydraulic back check hole 39, then below piston 22;
at 70 degrees, piston notch 21A blocks hydraulic chamber for delayed action 30.

From 70 degrees to 10 degrees the springs 23 continue to urge piston 21, 22 toward the closure caps 56. Hydraulic chamber for delayed action 30 opens below piston 21. The hydraulic fluid flow is as follows:

from above pistons 21 and 22;
to hydraulic chamber for latch 28;
to close valve 32;
to hydraulic middle upper chamber 61;
to hydraulic chamber for closing speed 37;
to hydraulic middle main chamber 62;
to hydraulic chamber for delay action 30;
to below piston 21;
to apex hole 41;
to well at interior 54;
to hydraulic main chamber 49;
to hydraulic ball hole back check 38A;
to hydraulic back check hole 39;
and to below piston 22;
at 10 degrees, hydraulic chamber for latch 28 is restricted momentarily.

From 10 degrees to 0 degrees, the broadpoint 15B touches stabilizer rack rise 48. The hydraulic fluid flow is as follows:

from above pistons 21 and 22;
to hydraulic last chamber 60;
to hydraulic upper chamber 36;
to latch valve 31;
to hydraulic chamber for latch 28;
to below both pistons 21 and 22.

The following is claimed as new and requested to be protected and secured by Leters Patent of the United States; I claim:

1. A door closer comprising:

a housing case with a step radius design on one elongated side;

a rack slide, with a broadpoint slot on each side of the rack slide through rack slide gears; a stabilizer rack rise at one end of the rack slide; and an opening in the center portion of the rack slide for receiving a pinion;

said pinion projecting out of the housing case off center towards the step radius design and said pinion being pivotably positioned in a circulate closure plate located on the top of the housing case, said pinion has pinion gears protruding outwardly and said pinion has an extending broadpoint receivable in said broadpoint slot, and said pinion further comprising allowance cuts for clearance of said stabilizer rack rise within said rack slide; two pistons operable in bores in said housing case and connected with the rack slide by corresponding connecting rods;

a hydraulic system within said housing case; and means to attach said housing case to a heater.

2. The door closer of claim 1 where said means to attach said housing case to a header is an integral curve arch butt cast anchor.

3. The door closer of claim 1 where said means to attach said housing case to a header is a prong tab cast anchor.

4. The door closer of claim 1 additionally comprising stabilizer ball holes in said pinion which nestle stabilizer balls urged forward by stabilizer ball springs within stabilizer ball holes in said rack slide.

5. The door closer of claim 1 additionally comprising broadpoint slots at each side of the interior of said housing case.

6. The door closer of claim 1 where said hydraulic system within said housing case comprises:

a fluid collection area above one of said pistons wherein the one of said pistons has an orifice which receives a ball;
a fluid collection area above the other piston;
a fluid collection area below said piston with ball;
a fluid collection area below said other piston;
a well at interior of said housing case;
an intrium wall with an apex hole between the fluid collection area below said piston with ball and the well at interior of said housing case;
a last chamber communicating between above the collection area of said piston with ball and above the collection area of said other piston;
a hydraulic chamber for back check which communicates between below the collection area of said piston with ball and below the collection area of said other piston when a door is open 70 degrees or less, but which is sealed by both pistons when said door is open more than 70 degrees;
a hydraulic chamber for latch communicating between above and below each piston depending on position of pistons;
a hydraulic chamber for delayed action communicating between above the collection area of said piston with ball and both the collection area below said other piston and said well at interior of said housing case when a door is closing from 120 degrees to 70 degrees;
a hydraulic main chamber connecting said well at interior of said housing case to a hole for back check, a back check ball, a back check valve, a delayed action valve, a hydraulic back check a hole, and a chamber for back check control;
a close valve connecting a hydraulic chamber for latch to hydraulic middle upper chamber, a hydraulic chamber for closing speed, a hydraulic chamber for delayed action; and a middle main chamber for delayed action;
a latch valve connecting a hydraulic last chamber to a hydraulic chamber for latch, hydraulic midchamber, and a hydraulic upper chamber; and
springs between the intrium wall and each piston where said ball has a piston notch.

7. The door closer of claim additionally comprising a top arm assembly into which a step block anchor with four screws for attaching to said projecting pinion.

* * * * *